US008443997B2

(12) United States Patent
Schmidl et al.

(10) Patent No.: US 8,443,997 B2
(45) Date of Patent: May 21, 2013

(54) TRANSPORT CASE FOR TRANSPORT OF HIGH-VALUE HEAVY TRANSPORT GOODS

(75) Inventors: Reinhold Schmidl, Fürstenfeldbruck (DE); Steffen Herschel, Poing (DE)

(73) Assignee: Océ Printing Systems GmbH, Poing (DE)

( * ) Notice: Subject to any disclaimer, the term of this patent is extended or adjusted under 35 U.S.C. 154(b) by 896 days.

(21) Appl. No.: 11/856,252

(22) Filed: Sep. 17, 2007

(65) Prior Publication Data

US 2008/0272136 A1 Nov. 6, 2008

(30) Foreign Application Priority Data

May 3, 2007 (DE) ..... 20 2007 006 355 U

(51) Int. Cl.
*B65D 21/02* (2006.01)

(52) U.S. Cl.
USPC ..... 220/23.89; 220/244; 220/651

(58) Field of Classification Search
USPC ..... 220/244, 812, 592.2, 592.26, 592.25, 220/23.89, 23.91, 651, 652, 653; 206/453, 206/521; 53/411
See application file for complete search history.

(56) References Cited

U.S. PATENT DOCUMENTS

| | | | | | |
|---|---|---|---|---|---|
| 1,304,772 | A * | 5/1919 | Hothersall | 220/810 |
| 2,239,128 | A * | 4/1941 | Sykes | 312/400 |
| 2,580,288 | A * | 12/1951 | Fainman | 508/204 |
| 3,080,087 | A * | 3/1963 | Cloyd | 220/324 |
| 3,392,682 | A * | 7/1968 | Francis | 410/42 |
| 3,459,395 | A * | 8/1969 | Scotto | 248/573 |
| 3,514,005 | A * | 5/1970 | Irwin | 220/1.5 |
| 4,015,715 | A * | 4/1977 | Kelf | 206/521 |
| 5,193,700 | A * | 3/1993 | Lyman et al. | 220/1.5 |
| 5,518,118 | A * | 5/1996 | Putz et al. | 206/449 |
| 6,971,826 | B2 * | 12/2005 | Valentine | 410/50 |
| 7,083,045 | B2 * | 8/2006 | Scott | 206/373 |
| 7,140,508 | B2 | 11/2006 | Kuhn et al. | |
| 2004/0149766 | A1 * | 8/2004 | Karpisek | 220/812 |
| 2005/0257232 | A1 * | 11/2005 | Hidaka | 720/654 |
| 2006/0032777 | A1 * | 2/2006 | Russell et al. | 206/521 |

* cited by examiner

*Primary Examiner* — Anthony Stashick
*Assistant Examiner* — Jeffrey Allen
(74) *Attorney, Agent, or Firm* — Schiff Hardin LLP

(57) ABSTRACT

In a transport case for transport of at least one high value, heavy transport goods, a floor is provided on which an object carrier is arranged on an inside of the case such that it can be displaced in a direction of a longitudinal axis of the case. At least one cover is connected with the floor with at least one hinge such that it can be folded over and the cover can be opened such that the transport good is freely accessible parallel to the longitudinal axis in an opened state of the transport case.

1 Claim, 5 Drawing Sheets

TRANSPORT CASE FOR TRANSPORT OF HIGH-VALUE HEAVY TRANSPORT GOODS

BACKGROUND

The preferred embodiment concerns a transport case of high-value, sensitive, bulky and/or heavy transport goods.

Wooden crates are typically used for the transport of high-value transport goods. It is thus known from U.S. Pat. No. 7,140,508 B2 to use a cuboid wooden crate for high-value objects (such as paintings), the inner walls of which crate are lined with vacuum insulation panels. These vacuum insulation panels serve for the protection of the highly sensitive transport goods.

However, if heavy transport goods are used, such vacuum insulation panels can easily be damaged upon removal of the transport good from the transport crate. Moreover, due to their high weight and/or their large dimensions such transport goods can only be removed from such a transport crate with difficulty or in an unwieldy manner.

SUMMARY

It is an object to achieve a transport case for transport of high-value, heavy transport goods in which the transport good can be simply and safely placed into the transport case or removed therefrom.

In a transport case for transport of at least one high value, heavy transport goods, a floor is provided on which an object carrier is arranged on an inside of the case such that it can be displaced in a direction of a longitudinal axis of the case. At least one cover is connected with the floor with at least one hinge such that it can be folded over and the cover can be opened such that the transport good is freely accessible parallel to the longitudinal axis in an opened state of the transport case.

DESCRIPTION OF THE PREFERRED EMBODIMENT

Figure 1:
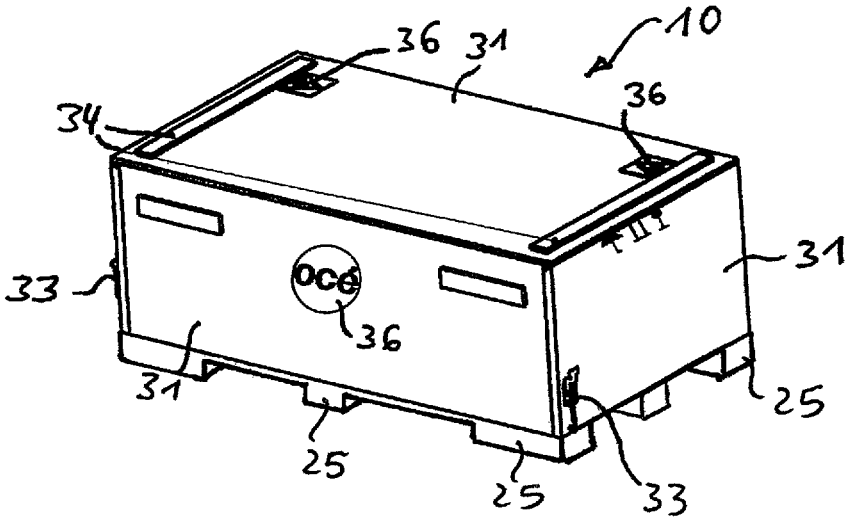
FIG. 1 is a view of a transport case in a closed state.

For the purpose of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

The transport case exhibits a floor that exhibits an object carrier facing towards the inside of the transport case, which object carrier is fastened on the floor such that it can be displaced in the direction of a longitudinal axis. A catch is additionally provided that holds the transport retainer still during the transport and otherwise allows a longitudinal displacement of the transport good so that it can be placed more easily into the transport case and can be removed more easily and simply. Furthermore, the transport case comprises a cover. When the cover is open, the transport good is easily accessible from two opposite sides.

In the following a transport case for transport of high-value heavy transport goods is explained in a first exemplary embodiment in which only a single transport good (designed in the following as an object to be transported) can be conveyed with the transport case. A transport case in which at least two objects can be transported is explained in a further exemplary embodiment. There a developer station for electrophotographic high-capacity printers is shown by way of example as an object to be transported. It is naturally understood that other high-value, heavy and sensitive objects can also be transported, independent of the number of objects in a case. The preferred embodiment therefore does not depend on the type of the object and the number of the object, but rather essentially on the principle of how the objects are borne in the transport case and can be removed from this. For this it is also important how the transport case can be opened so that the objects can be removed.

A first exemplary embodiment of a transport case 10 for transport of high-value, heavy objects 11 are shown in FIG. 1. The transport case 10 is thereby shown in a closed state. This transport case 10 is designed cuboid-shaped and comprises a floor 20 (not shown in FIG. 1) and a cover 30. The cover 30 here comprises five side walls 31 and is designed substantially box-shaped. The individual side walls 31 do not thereby have to be permanently connected with one another. They can also be connected with each other such that they can move via hinges 32.

The floor 20 comprises a single floor plate 21 that is designed approximately plate-shaped. In the event that the floor plate 21 is produced continuously from solid material, this represents a protection against splash water or other dirt.

The transport case 10 comprises locking mechanisms 33 with which the transport case 10 can be secured during the transport so that an unauthorized access to the object 11 is prevented or at least made more difficult. Furthermore, the side walls 31 exhibit on their outsides or insides reinforcement parts 34 such as ribs, whereby the individual walls 31 (on the top side of the transport case 10 in FIG. 1) are mechanically reinforced. The ribs can also comprise a cushioning material when they are arranged on the inside of the transport case 10. They can serve as additional cushioning for the objects 11.

Figure 2:
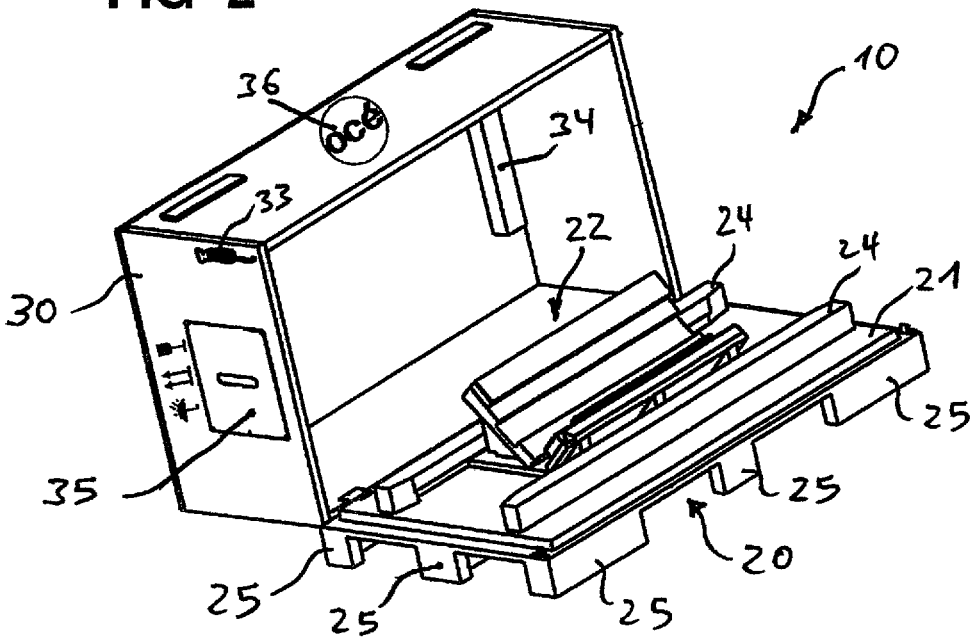
FIG. 2 is a view of the transport case according to FIG. 1 in an opened state.

The transport case 10 is shown in an opened state in FIG. 2. There the floor 20 that comprises the floor plate 21 is visible. An object carrier 22 is arranged on the floor plate 21 (on the inside of the case). The object carrier 22 is designed as slides with rollers 23 (FIG. 4) or other suitable sliding structures, whereby the object carrier 22 can be moved back and forth along rails 24 in a longitudinal direction.

The floor plate 21 comprises on the outside of the case (i.e. on the underside) a plurality of feet 25 that are separated from one another. The distances are measured such that a lift truck or a forklift can move under the floor plate 21 with its fork from any side and can raise the transport case 10. The distances are universally set to the respective fork width of possibly employed forklifts. The feet 25 can also be designed as pinnacle fork lift feet. The floor 20 is thus designed in the manner of a transport pallet.

Given smaller transport cases 10 it is sufficient when the feet 25 are arranged only on the edges. Given larger transport cases 10, the feet 25 can also be arranged distributed matrix-like over the floor plate 21.

The box-shaped cover 30 is connected with the floor 20 by means of hinges 32. The hinges 32 are laterally arranged on the floor plate 21 such that the cover 30 can be opened parallel to the longitudinal axis. In the opened state the object 11 located on the object carrier 22 is well accessible parallel to the longitudinal axis and can be placed on the object carrier 22 or removed from this. The object 11 can thus be closely approached with an aid and be grasped well by this.

The object carrier 22 comprises a plurality of support elements 27 whose shape and arrangement are adapted to the respective object 11 to be transported. Padding elements 26 (also designated as cushioning elements or pads) are arranged between the support elements 27 on which the object 11 rests and the respective base 28. This serves for mechanical protection of the object 11 from mechanical shocks. The object 11 is additionally protected from scratches.

Here the object carrier 22 is designed approximately L-shaped. The padding elements 26 and support elements 27 are respectively arranged at both ends and in the middle of the object carrier 22.

The object carrier 22 can additionally comprise shock absorption systems (not shown in Figures) that further protect the object 11 from mechanical shocks. Such shock absorption systems can be shock absorbers or other, suitable active or passive elements absorbing shocks. Shock indicators can also be attached to a wall 31, whereby an indication is received of whether the object 11 has experienced a too-strong shock during the transport.

Figure 3:
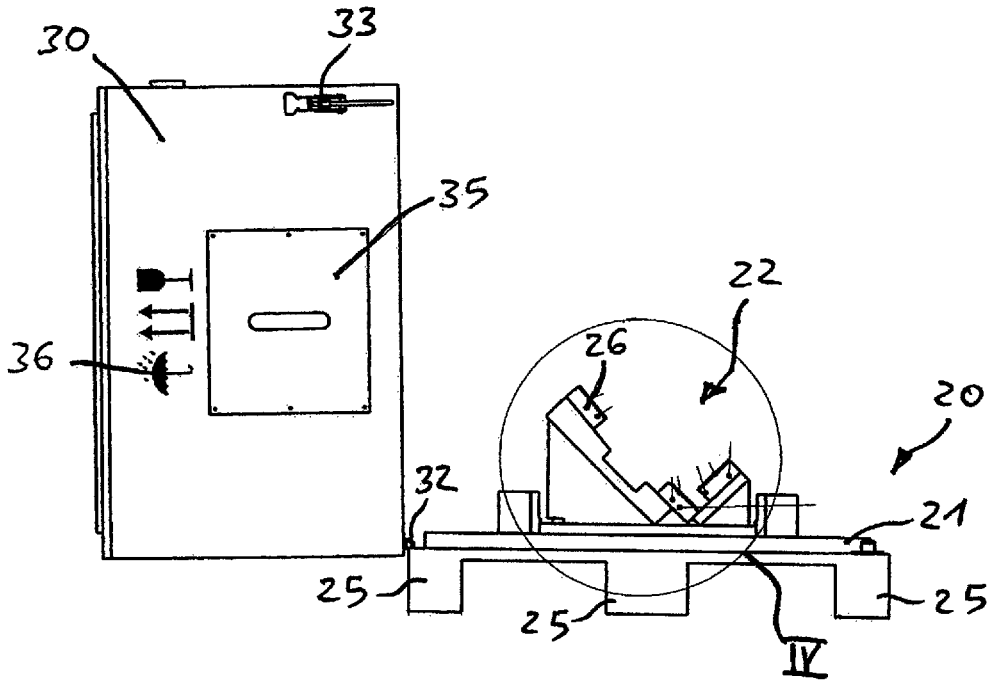
FIG. 3 is a side view of the transport case according to FIG. 2 in an opened state.

As shown in FIG. 3, the transport case 10 can comprise a shipping pouch 35 on the outside of one side wall 31, in which shipping pouch shipping papers can be placed. Furthermore, the outsides can exhibit different imprints 36 that serve as warning notices or treatment instructions for the transporter.

Figure 4:
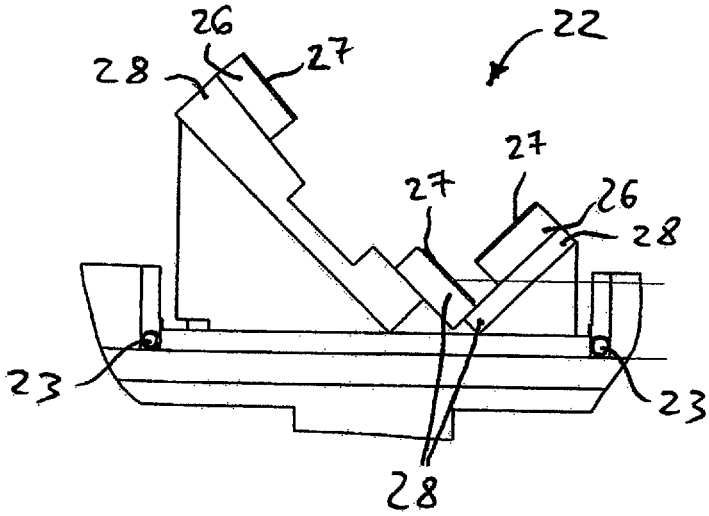
FIG. 4 is a detail view of the transport case according to FIG. 3.

The object carrier 22 is shown enlarged in FIG. 4 (enlargement of the circle IV in FIG. 3). The support elements 27 with the padding elements 26 are well recognizable there. The support elements 27 are borne on stable bases. Very heavy objects 11 can thus also be transported.

Moreover, the rollers 23 are visible that slide on the rails 24. An object carrier 22 can therewith easily slide along with or without a placed heavy object 11. The displacement direction is on the side of the floor 20 freely accessibly in the opened state of the transport case 10. This makes the loading or unloading of the object 11 from the transport case 10 easier. The gripping or acceptance by an aid is likewise made easier.

A further exemplary embodiment of a transport case 10 is shown in FIG. 5 through 8. Functionally identical parts in FIGS. 5 through 8 have the identical reference characters as in FIGS. 1 through 4.

Figure 5:
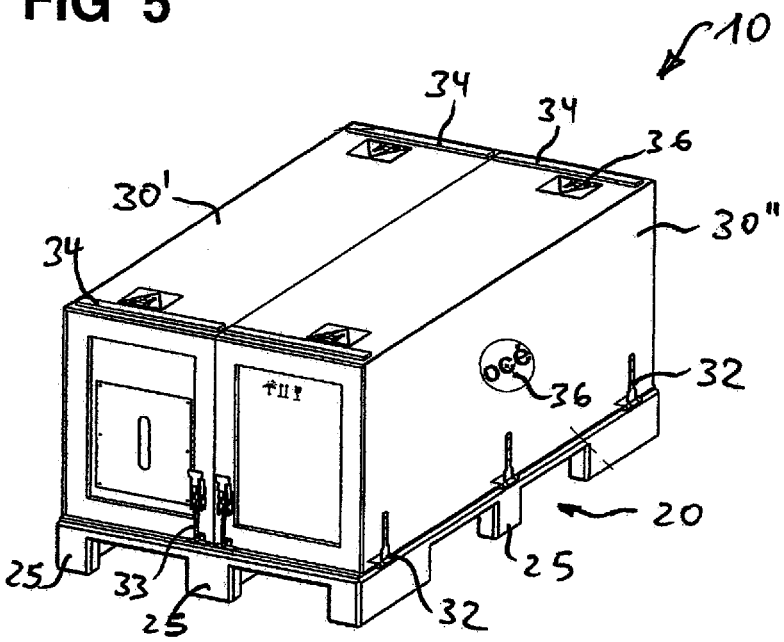
FIG. 5 is a further exemplary embodiment of a transport case in a closed state.
Figure 6:
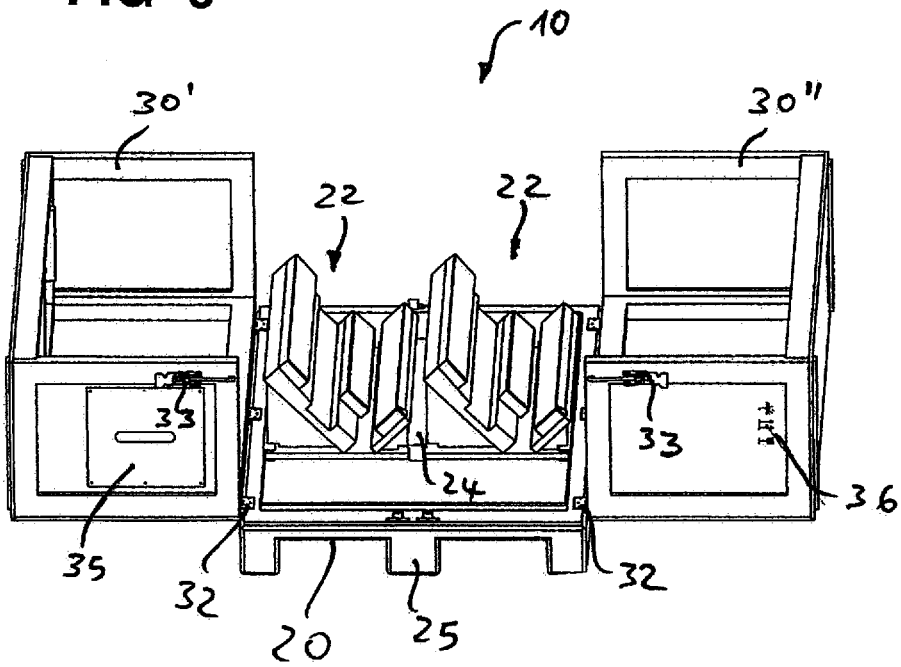
FIG. 6 shows the transport case according to FIG. 5 in an opened state.

The transport case 10 is shown in FIG. 5 in a closed state. In this exemplary embodiment the cover 30 is divided into two (cover parts 30' and 30"). In the closed state each individual cover 30', 30" can be locked by means of locking mechanisms 33. Each cover 30', 30" is connected with the floor 20 by means of hinges 32. The hinges 32 for a cover 30' or 30" are respectively fastened on one side of the cover plate 21. The two covers 30' and 30" are thus fastened such that they can be folded over on opposite sides of the floor 20. Each cover 30', 30" can thus be opened separately (however in the opposite direction) in order to uncover the object carrier 22, as is shown in FIG. 6.

When the two covers 30', 30" are entirely opened, an easy access to the object carriers 22 is ensured. In particular at the two sides at which no cover 30', 30" blocks the direct access, an object 11 can be removed from the object carriers 22 parallel to the longitudinal axis of the object carrier 22 or be placed there. The object 11 can be simply removed or placed via the longitudinal displacement of the two object carriers 22 at one of the two free facing sides of the floor 20 since a lifting unit for bringing or fetching the object 11 can be brought very close to the object carriers 22 and the slides with the object carrier 22 can be shifted to the edge of the floor 20.

In this exemplary embodiment two object carriers 22 are arranged in a transport case 10 with two covers 30', 30". Naturally, one or more object carriers 22 can also be arranged in the single transport case 10. A limitation of the object carriers 22 occurs only due to the total weight and the dimensions of the objects 11 to be transported. The transport case 10 must therefore be adapted to these in terms of its measurements (dimensioning, external measurements, wall thicknesses etc.).

Figure 7:
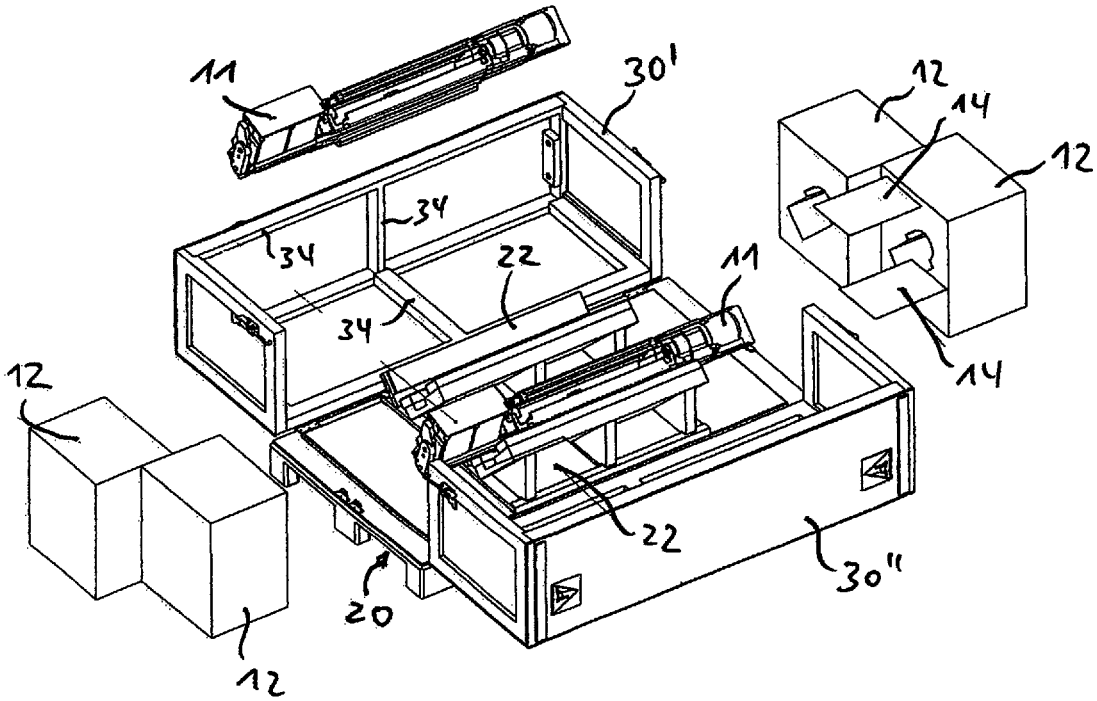
FIG. 7 is a perspective view of the transport case according to FIG. 5 in an opened state, whereby two transport goods (not yet completely packed) are shown.

Two developer stations for an electrophotographic high-capacity printer are exemplarily shown in FIG. 7 as objects 11 to be transported. Such a developer station is a high-value, heavy and sensitive apparatus that comprises many metal parts (rollers, electromotors, reservoirs, tubes etc.) and is produced to a very high precision. It must be particularly protected in transport. For the loading or extraction of the developer station from the transport case 10 it requires tools such as a special lift truck. The weight of such a station can be far more than 50 kg.

In the exemplary embodiment according to FIG. 7 a developer station is already placed on the object carrier 22. The other developer station is presently delivered. The lift truck is not shown here. The object carriers 22 with their bases 28 and support elements 27 are advantageously designed such that the developer station can already be transported in its later printer installation position, be taken from the transport case 10 without further handling and can also be installed into the printer in this alignment. This has the advantage that the developer station no longer has to be rotated or turned but rather can be immediately extracted and installed in the printer in the correct installation position.

The developer stations, surrounded with additional protective casings, can be placed on the object carriers 22. The developer stations can also be fastened on the object carriers 22. So that the object carriers 22 do not move during the transport, one or more catches (not shown in Figures) are provided via which the object carrier 22 is fixed during the transport.

Cushions 12 can additionally be provided that are slid over the respective ends of the developer stations (which are designed oblong). The cushions 12 can be produced from hard foam, polystyrene or functionally identical material. They can be fastened to the developer station by means of adhesive tape or tension belts 13, for example. The floor plate 21 can comprise retainers in which the tension belts 13 can be threaded for fastening.

In order to be able to not damage the cushions 12 upon fastening, protective elements 14 such as protective plates, protective edge plates and others can be placed directly on the outsides of the cushions 12. In the event that the covers 30', 30" are closed, the cushions 12 almost abut the side walls 31. The further movement is prevented by the strong cushioning. The cushions 12 also abut the upper side walls 31 of the cover 30' and 30" in the event that the cushions 12 are dimensioned correspondingly large and are adapted to the side walls 31 in terms of their dimensions. It is thus ensured that the developer stations are protected from damages upon sliding given unintended release during the transport. Even given strong shocks during the transport (for example swaying of a freight ship, aircraft etc. in which the transport case 10 is transported), the objects 11 remain protected.

Figure 8:
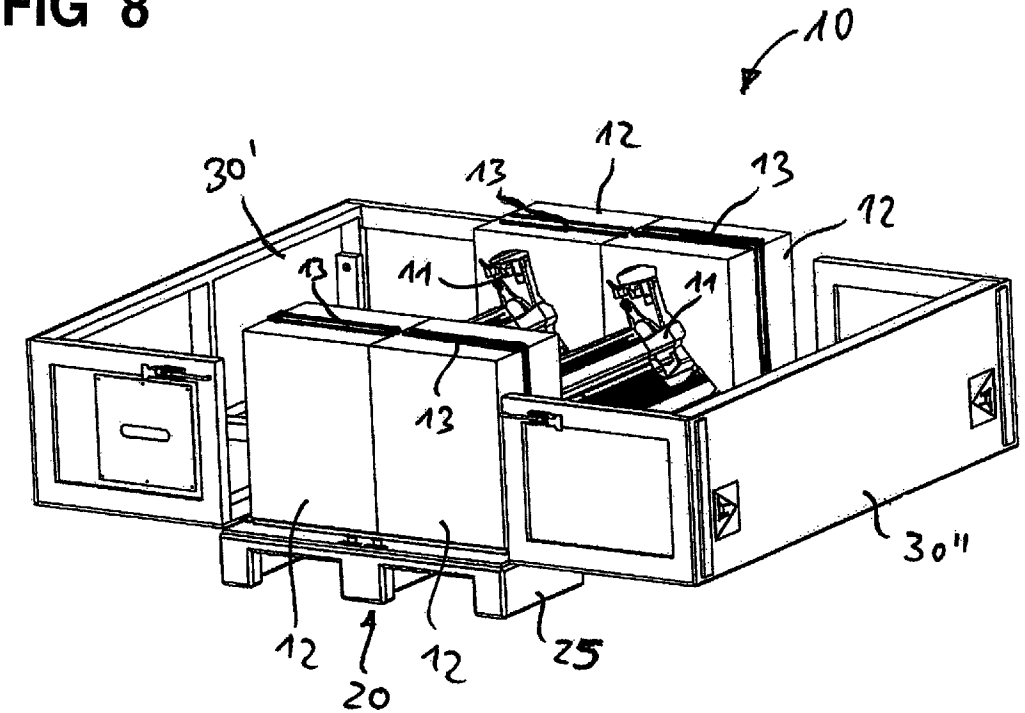
FIG. 8 is a view of the transport case according to FIG. 5 in an opened state with transport goods at the point provided for them on object carriers.

The completely packed developer stations are visible in FIG. 8. Only the two covers 30', 30" are open. The developer stations are fastened on the object carriers 22 and are provided at their ends with the cushions 12 that for their part are fastened at the ends of the developer stations by means of tension belts 13.

The transport case 10 now only needs to be closed and the locking mechanisms locked so that the developer station can be securely transported.

To unload the objects 11 the covers 30', 30" are first opened and the cushions 12 are removed. A lift truck can now approach a free side. The object carriers 22 are displaced longitudinally towards the lift truck. The developer stations can be partially shifted onto the lift truck via the longitudinal displacement of the object carriers 22 while the bearing fork of the lift truck are moved into the region of a developer station.

Such a transport case 10 with a rectangular floor 20 is advantageously provided and, together with the cover 30, forms a cuboid. Naturally other geometric shapes can also be suitable to form the transport case 10. All transport cases 10 thereby exhibit the object carriers 22 that can be longitudinally displaced and covers 30 borne such that they can rotate around the longitudinal axis, which covers 30 in the opened state enable the free access to the objects 11. The objects 11 can be displaced beyond the edge of the transport case 10 with the object carriers 22 in order to then be removed. If the objects 11 are not too heavy, they can also simply be manually unloaded. It is thereby advantageous that a person on the free side can come close enough to the objects, particularly as the objects can be moved towards the person by means of longitudinally displaceable object carriers 22.

In the event that the transport case 10 is designed as a cuboid, this has the advantage that a plurality of transport cases 10 can be stacked easily.

When sensitive objects 11 are transported, the walls of cover 30 and floor 20 can thus respectively comprise additional coatings, whereby the objects 11 are protected from moisture, dirt or electromagnetic radiation. Depending on the protection, the coatings can be made from different material. It is thus advantageous to produce the coatings from materials that conduct electricity well (such as metals—copper, silver, iron etc.) in the event that there should be protection against electromagnetic waves. Plastics and/or composite materials are likewise possible. Alternatively, it is possible that the walls of the transport case 10 are produced from a corresponding material (plastic, metal). Such parts can then, for example, be produced via injection molding. Instead of or in addition to the coatings, thin plates (such sheets) can also be applied on the inside of the transport case 10. They serve for the same purpose as the coatings.

In the event that two covers 30', 30" are present and two object carriers 22 are present per cover 30', 30", the covers 30', 30" can also be opened independent of one another so that an object 11 can already be uncovered and be extracted along the longitudinal axis with the aid of a lift truck or other aid via opening of only one cover 30' or 30". The objects 11 can thereby easily be grasped and removed relatively comfortably from the transport case 10.

While a preferred embodiment has been illustrated and described in detail in the drawings and foregoing description, the same is to be considered as illustrative and not restrictive in character, it being understood that only the preferred embodiment has been shown and described and that all changes and modifications that come within the spirit of the invention both now or in the future are desired to be protected.

We claim as our invention:

1. A transport case for a transport of at least one high-value, heavy transport good, said transport case comprising:

a floor with no integral sidewalls extending up from the floor and on which a movable object carrier for receiving and movable together with said transport good thereon is arranged on an inside of the case such that the object carrier is movable together with the transport good thereon in a direction of a longitudinal axis of the case, and a catch being provided that holds the movable object carrier in place during the transport;

said object carrier forming a tilted L-shaped pocket comprising two walls meeting and being connected adjacent a vertex to form a single body for receiving said transport good and wherein legs of said pocket forming the L-shape extending at respective transverse angles with respect to a horizontal surface of the floor on which the object carrier is arranged;

the object carrier is designed as a slide that comprises rollers that run on rails on the floor of the transport case; and at least one cover connected with the floor along a hinge axis wherein the hinge axis is parallel to said case longitudinal axis and with at least one hinge such that the cover is foldable over and so that the cover when opened permits the transport good to be freely accessible and movable via said object carrier parallel to the case longitudinal axis and the hinge axis in an opened state of the transport case so that the object carrier is shiftable to an outside edge of the floor.

* * * * *